US005829368A

United States Patent [19]

Cote et al.

[11] Patent Number: 5,829,368

[45] Date of Patent: Nov. 3, 1998

[54] FUEL AND SORBENT FEED FOR CIRCULATING FLUIDIZED BED STEAM GENERATOR

[75] Inventors: Gary A. Cote, Granville, Mass.; Paul J. Panos, Windsor, Conn.

[73] Assignee: Combustion Engineering, Inc., Windsor, Conn.

[21] Appl. No.: 774,403

[22] Filed: Dec. 31, 1996

[51] Int. Cl.[6] ..... F23K 3/00; F23K 3/02; F23G 5/30; F23B 7/00

[52] U.S. Cl. ..... 110/342; 110/101 R; 110/101 CF; 110/105; 110/245; 110/347; 110/348

[58] Field of Search ..... 110/245, 101 R, 110/101 CF, 105, 105.6, 106, 348, 347

[56] References Cited

U.S. PATENT DOCUMENTS

| | | | |
|---|---|---|---|
| 3,669,502 | 6/1972 | Leman | 110/105 X |
| 4,102,278 | 7/1978 | McManama | 110/105 |
| 4,476,790 | 10/1984 | Borio et al. | 110/245 |
| 4,528,917 | 7/1985 | Jacobs | 110/300 |
| 4,532,872 | 8/1985 | Anderson | 110/255 |
| 4,722,287 | 2/1988 | Anderson et al. | 110/263 |
| 4,947,803 | 8/1990 | Zenz | 110/245 X |
| 4,993,332 | 2/1991 | Boross et al. | 110/347 |
| 5,033,413 | 7/1991 | Zenz et al. | 110/245 X |
| 5,236,470 | 8/1993 | Levin | 110/346 X |

*Primary Examiner*—Allen Flanigan
*Assistant Examiner*—Ljiljana V. Ciric
*Attorney, Agent, or Firm*—Alix, Yale & Ristas, LLP

[57] ABSTRACT

The fuel is fed into a circulating fluidized bed steam generator using a feed system involving an air swept chute using secondary combustion air to suspend and carry the fuel into the fluidized bed combustor. The fuel is fed to the air swept chute through a gravity feed chute at a steep angle. The air swept chute is lined with an abrasion resistant material.

4 Claims, 1 Drawing Sheet

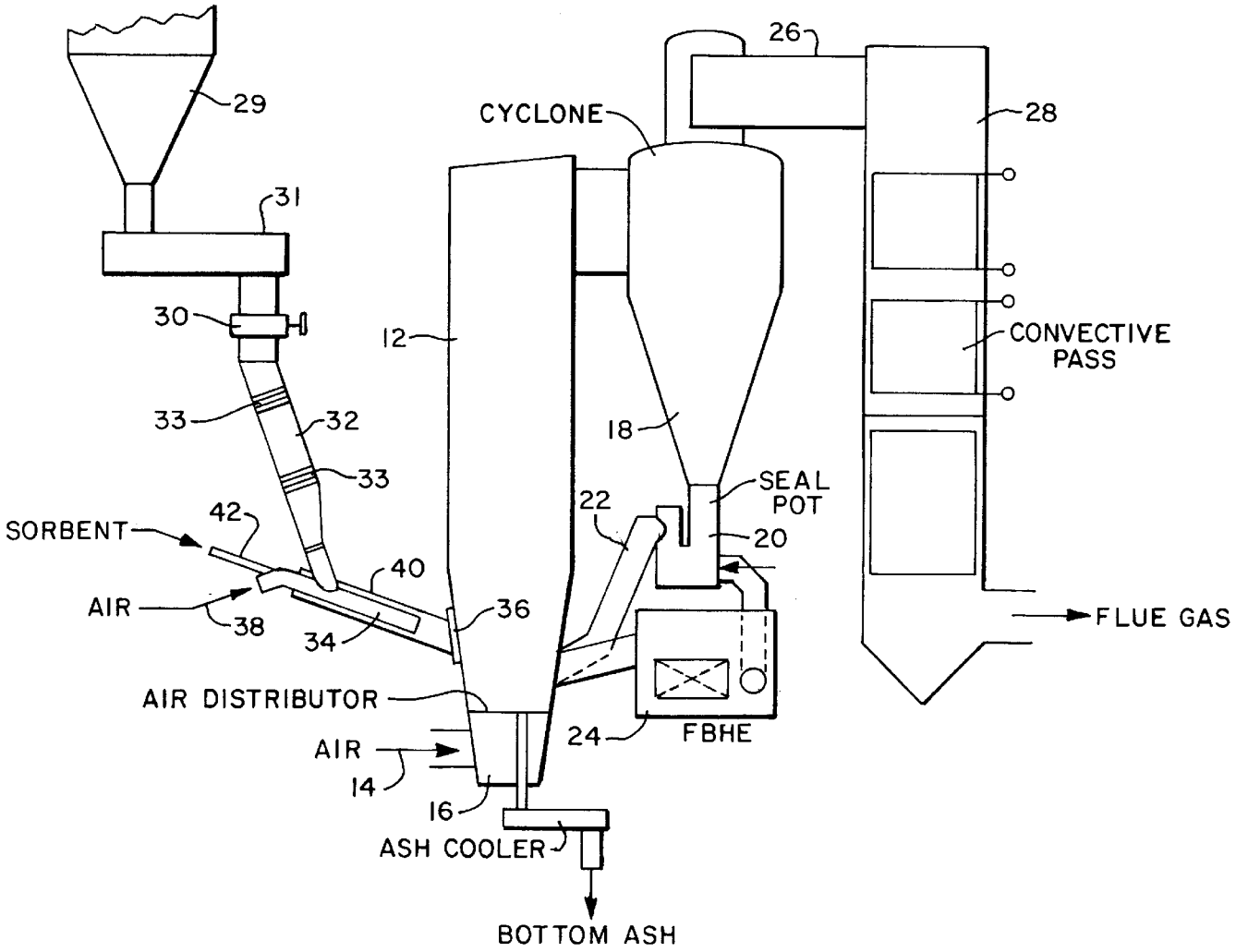
FLUE GAS
CONVECTIVE PASS
28
26
SEAL POT
20
FBHE
CYCLONE
18
22
24
BOTTOM ASH
ASH COOLER
36
16
12
40
AIR
14
AIR DISTRIBUTOR
34
32
33
31
29
30
33
42
38
SORBENT
AIR

FUEL AND SORBENT FEED FOR CIRCULATING FLUIDIZED BED STEAM GENERATOR

BACKGROUND OF THE INVENTION

The present invention relates to circulating fluidized bed steam generators and specifically to a fuel feed chute and sorbent feed arrangement.

Fluidized bed combustion has gained favor for a number of reasons. An outstanding feature is its ability to burn high-sulfur fuels in an environmentally acceptable manner without the use of flue-gas scrubbers. In fluidized-bed combustion, much of the sulfur contained in the fuel is removed during combustion by a sorbent material in the fluid bed, usually limestone. In this process, the production of nitrogen oxides is low because of the low temperature at which the combustion reaction takes place.

One type of fluidized bed combustion is the circulating fluidized bed system. In this system, the gas velocities in the furnace are three to four times as high as in conventional bubbling fluidized bed system. The small solid particles are carried up through the furnace and a uniform lower-density gas/solids mixture exists throughout the entire furnace. Since the solids move through the furnace at much lower velocities than gas, significant solids residence times are obtained. The long residence time coupled with the small particle size produce high combustion efficiency and high sulfur oxide removal with lower sorbent limestone feed.

A problem with fluidized bed steam generators is feeding the particulate (pulverized or crushed) coal or petroleum coke fuel into the combustor. Since the fuels may vary in composition, particle size and moisture content and since the fuel feeding chutes can vary in materials of construction and wall friction, plugging of the chutes can be a problem. Although steep-angle chutes may avoid that problem, that is usually not practical for the portion of the chutes feeding into the nozzles in the combustor.

SUMMARY OF THE INVENTION

The present invention relates to the feeding of the fuel into a fluidized bed using a feed system involving an air swept chute or pipe portion using the secondary air to suspend and carry the fuel into the combustor. The invention also may involve the feeding of the sorbent into the fuel feed piping to be mixed with and fed with fuel into the combustor with secondary air. More specifically, the feed system includes a gravity feed chute which is at a steep angle to prevent plugging and which feeds the fuel into the air swept chute or pipe at a lesser angle. The air swept chute of pipe is lined with an abrasion resistant material.

BRIEF DESCRIPTION OF THE DRAWING

The drawing illustrates the fuel feed system of the present invention in association with a circulating fluidized bed steam generator.

DESCRIPTION OF THE PREFERRED EMBODIMENT

Referring to the drawing, a typical fluidized bed combustor system is illustrated beginning with the fluidized bed furnace 12. The particulate fuel, usually pulverized or crushed coal, and sorbent, usually limestone, are fed to the furnace as will be described hereinafter. The primary fluidizing air 14 is fed to the air plenum chamber 16 in the bottom of the furnace 12. Secondary combustion air is also fed to the furnace as will be described later in connection with the description of the fuel and sorbent feed system. The bottom portion of the furnace 12 is refractory lined for corrosion and erosion protection while the upper portion contains the evaporative waterwalls.

The solids carried from the furnace 12 along with the flue gas are separated from the flue gas in the cyclone separator 18. The solids are discharged from the bottom of the cyclone separator, flow through a known seal pot or syphon seal arrangement 20 from which the solids are then returned via the duct 22 to the furnace 12. A part of the solids may flow through the fluidized bed heat exchanger 24 for the extraction of heat before being recycled to the furnace. The fuel gas exits the top of the cyclone separator 18 and is fed by duct 26 into the convection section 28 for heat recovery. The flue gas would then typically be treated in a dust collector and used to preheat the incoming primary and secondary combustion air before being passed to the stack.

The fuel feeding system of the present invention begins with the fuel silo 29 where the crushed or pulverized coal or coke is stored. The fuel flows from the silo 29 to the gravimetric feeder 31 which measures and feeds the fuel at a selected rate. From the gravimetric feeder 31, the fuel drops by gravity through an isolation gate 30 and into the gravity chute 32 of the fuel feed chute arrangement. This gravity portion 32 is sloped about 55° to 80° from the horizontal and preferably at about 70° which is selected to function with all fuels even if unpolished stainless or carbon steel is used as opposed to being polished. Expansion joints 33 function as a toggle to compensate for thermal expansion.

The fuel from the gravity chute 32 enters the air-swept chute 34 which is one of the secondary air pipes connected with one of the secondary air ports 36 of the furnace. The secondary air 38 serves as the transport air for the fuel. This secondary air is of a quantity and velocity such that the fuel is suspended in the air rather than being merely pushed along as a dense phase by a low flow air assist. As an example, the velocity range for the secondary air flow to pick up and suspend the fuel is about 70 to 110 feet per second for one quarter inch coal and is usually about 90 feet per second. Although the angle of the chute portion 34 is not critical,it is preferably at about 20° from the horizontal.

Introducing the fuel, which is abrasive, into the air-swept chute 34 with air moving at the required velocity creates a major erosion potential. Therefore, the chute 34 is lined with an abrasion resistant material 40, preferably a ceramic material.

Since there are pressure losses through the air-swept chute 34, the secondary air pressure required to convey the fuel and overcome the pressure loss must be higher than the normal secondary air pressure would be if it were not conveying the fuel and suffering the pressure loss. As an example, this pressure loss might be on the order of 0.5inches Hg or 7 inches $H_2O$. Therefore, it is preferred that the secondary air used for transporting the fuel actually be taken from the primary air fans rather than the secondary air fans. Again as a specific example, the pressure from the primary air fan may be about 15 inches $H_2O$ higher than the pressure from the secondary air fan. This arrangement thereby provides sufficient pressure to overcome the pressure lost by the fuel transport and still have a sufficient remaining pressure differential above the pressure in the combustor.

Another feature of the invention is the feeding of the sorbent such as limestone or dolomite through the feed nozzle 42 concentrically into the fuel feed chute 34. With this arrangement, the sorbent as well as the fuel is fed to the furnace by the secondary air. It provides for intimate contact between the fuel and the sorbent thereby improving sulfur capture and reducing the consumption of sorbent.

The secondary air can be either hot or cold (by passing the air heater) for the fuel transport. The feed chute is preferably insulated so that there will be no concern with moisture from the fuel condensing out on the pipe wall and causing the fuel to stick. It is preferred that hot transport air be used since cold transport air will lower the boiler efficiency.

What is claimed is:

1. A method of feeding a particulate fuel and a sorbent material into a fluidized bed combustion system wherein said system comprises a fluidized bed furnace having means for supplying primary combustion and fluidizing air located in the bottom portion of said furnace and a port for supplying secondary combustion air located above said bottom comprising the steps of:

a. feeding a particulate fuel into a gravity feed chute;

b. passing said particulate fuel from said gravity feed chute into an air-swept chute connected to said secondary air port;

c. injecting sorbent material concentrically into the center of said air-swept chute; and d. supplying secondary combustion air to said air-swept chute at a velocity whereby said particulate fuel and said sorbent material are suspended in said secondary air, and whereby said secondary air and said suspended fuel and said sorbent material are mixed and transported into said fluidized bed furnace through said air-swept chute and said secondary air port.

2. A method of feeding a particulate fuel and a sorbent material into a fluidized bed combustion system wherein said system comprises a fluidized bed furnace having means for supplying primary combustion and fluidizing air located in the bottom portion of said furnace and a port for supplying secondary combustion air located above said bottom comprising the steps of:

a. feeding a particulate fuel into a gravity feed chute;

b. passing said particulate fuel from said gravity feed chute into an air-swept chute connected to said secondary air port;

c. feeding a sorbent material into a sorbent feed nozzle separate from said gravity feed chute;

d. passing said sorbent material from said sorbent feed nozzle into said air-swept chute; and e. supplying secondary combustion air to said air-swept chute at a velocity whereby said particulate fuel and said sorbent material are suspended in said secondary air, and whereby said secondary air and said suspended fuel and said sorbent material are thereby mixed and transported into said fluidized bed furnace through said air-swept chute and said secondary air port.

3. Fuel feeding means for feeding a particulate fuel and a sorbent material into a fluidized bed combustion system wherein said system comprises a fluidized bed furnace having means for supplying primary combustion and fluidizing air located in the bottom portion of said furnace and a secondary air port for supplying secondary combustion air located above said bottom comprising:

a. a gravity feed chute for receiving said particulate fuel and being inclined downwardly at an angle from the horizontal such that said particulate fuel will fall through said gravity feed chute to a lower discharge end of said gravity feed chute;

b. an air-swept feed chute located at the lower discharge end of said gravity feed chute and connected to said secondary air port;

c. a sorbent feed conduit connected to said air-swept feed chute for feeding sorbent into said air-swept feed chute separate from said particulate material; and d. means for supplying secondary combustion air to said air-swept feed chute past said lower discharge end of said gravity feed chute and past said sorbent feed conduit and into said fluidized bed furnace through said secondary air port whereby said particulate fuel and said sorbent material are mixed and suspended in said secondary combustion air and thereby injected into said fluidized bed furnace in suspension.

4. Fuel feeding means as recited in claim 3 wherein said air-swept feed chute is ceramic-lined.

* * * * *